US005413742A

United States Patent [19]

Gatter

[11] Patent Number: 5,413,742

[45] Date of Patent: May 9, 1995

[54] POST-MIX BEVERAGE APPARATUS INCLUDING HEAT EXCHANGER FOR NON-CARBONATED WATER

[75] Inventor: Raimond Gatter, Bretten, Germany

[73] Assignees: The Coca-Cola Company, Atlanta, Ga.; Bosch-Siemens Hausgerate GmbH, Munich, Germany

[21] Appl. No.: 233,965

[22] Filed: Apr. 28, 1994

[30] Foreign Application Priority Data

Aug. 28, 1992 [DE] Germany ..... 42 28 775.8

[51] Int. Cl.[6] ..... B67D 5/62

[52] U.S. Cl. ..... 261/140.1; 261/158; 261/DIG. 7; 222/146.6

[58] Field of Search ..... 222/146.6; 261/DIG. 7, 261/140.1, 158

[56] References Cited

U.S. PATENT DOCUMENTS

| | | | |
|---|---|---|---|
| 3,926,342 | 12/1975 | Selvia et al. | 261/DIG. 7 |
| 4,008,832 | 2/1977 | Rodth | 222/146.6 |
| 4,304,736 | 12/1981 | McMillin et al. | 261/DIG. 7 |
| 4,597,509 | 7/1986 | Pereira | 261/DIG. 7 |
| 5,086,951 | 2/1992 | Nakayama et al. | 222/146.6 |

FOREIGN PATENT DOCUMENTS

| | | |
|---|---|---|
| 471343 | 2/1992 | European Pat. Off. . |
| 2194508 | 3/1988 | United Kingdom . |
| 2205638 | 12/1988 | United Kingdom . |

OTHER PUBLICATIONS

International Search Report and U.S. counterpart U.S. Pat. No. 5,184,942 to EPO reference 471,343.

*Primary Examiner*—Tim Miles

[57] ABSTRACT

A post-mix beverage preparation and dispensing unit includes a carbonator tank coupled to a feed water branching circuit. The branching circuit selectively feeds fresh water from a pressurized fresh water source to the storage tank where the water is mixed with $CO_2$ gas and is fed to a concentrate mixing station or it feeds fresh water through a heat exchanger which is coupled to the cooled carbonated water of the carbonator tank to cool a supply of fresh water which is then delivered to the same mixing station along with the proper concentrate of the proper amount. A selected beverage is delivered to a dispensing station and can either be a carbonated beverage or a non-carbonated beverage depending on the desire of the consumer.

11 Claims, 1 Drawing Sheet

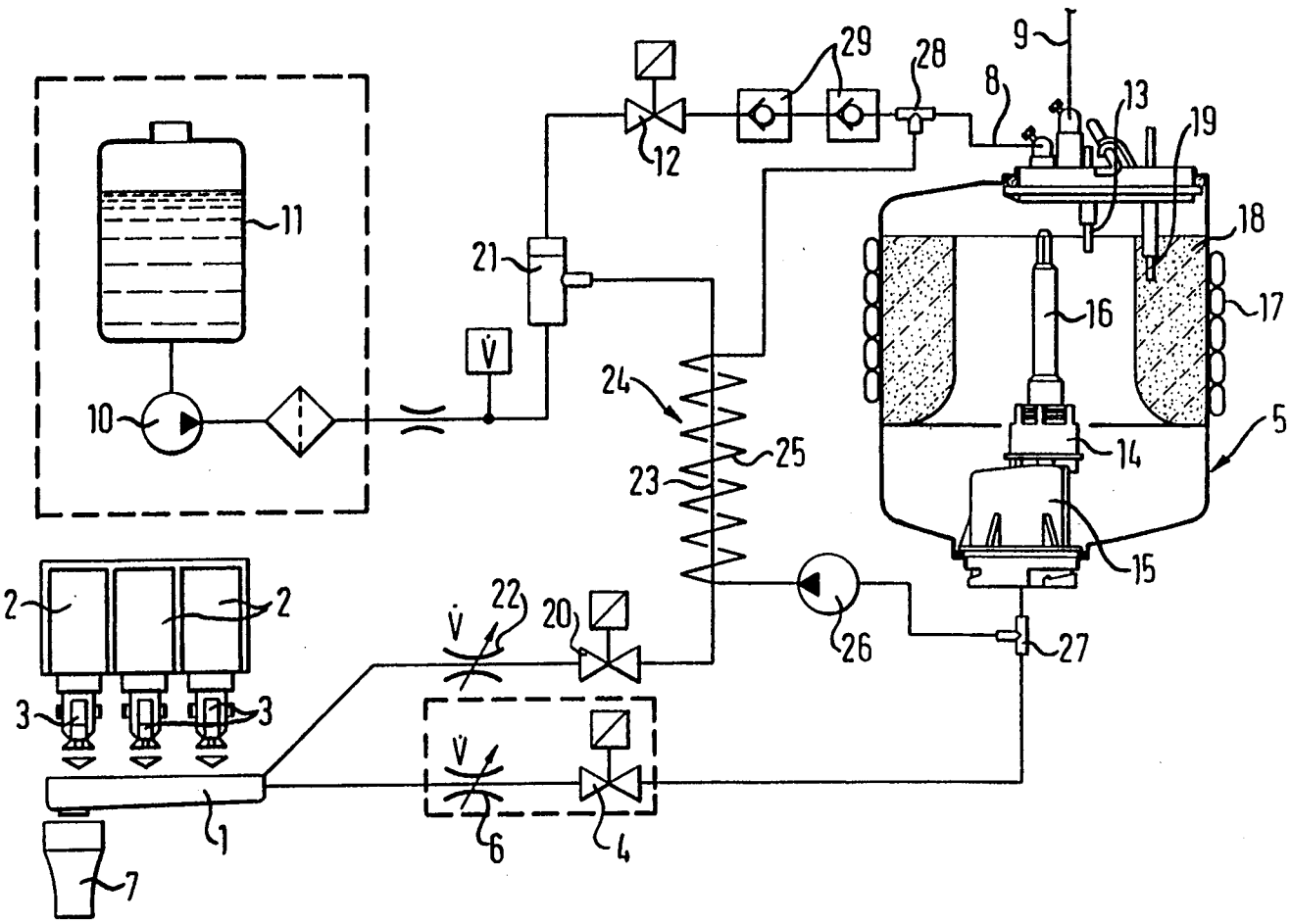
5
17
18
19
13
9
8
28
29
12
16
14
15
27
26
25
24
23
21
20
22
4
6
11
10
2
3
1
7

POST-MIX BEVERAGE APPARATUS INCLUDING HEAT EXCHANGER FOR NON-CARBONATED WATER

This is a continuation of International Application PCT/EP93/02280, with an international filing date of Aug. 25, 1993.

BACKGROUND OF THE INVENTION

This invention relates to apparatus for preparing and dispensing beverages wherein one of a plurality of drink concentrates and cooled fresh water enriched with $CO_2$ gas, and forming carbonated water thereby, are brought together in a predetermined ratio for preparing a selected type of a carbonated beverage and where the fresh water is blended with $CO_2$ gas in a cooled storage tank, referred to as a carbonator, that is refilled from a source of water by a pressure pump and a water level controlled intake valve.

Apparatus for mixing fresh water with $CO_2$ gas to produce carbonated water is well known and is used, for example, in post-mix beverage dispensing machines so that carbonated beverages can be prepared and dispensed on demand by mixing carbonated water with a suitable drink concentrate. As noted above, the carbonated water mixed with the drink concentrate is produced directly in the storage tank or carbonator. The carbonator is normally fed fresh water of drinking quality either from a pressurized water line; however, it can be supplied from a pressurized storage tank. A nonreturn check valve is located in the feed line to prevent a return flow. Further, $CO_2$ gas is fed to the carbonator from a $CO_2$ gas storage tank by a pressure-reducing regulating valve so that a pressure of, for example, about 4 bars is built up in the carbonator.

In order to ensure sufficient carbonation of the fresh water, the carbonation process is accomplished by or assisted by the use of a circulating pump located in the carbonator. This type of pump draws $CO_2$ gas from the upper or head-space region of the carbonator filled with $CO_2$ gas and blends it with circulating water which is set in circular motion, such as by spinning.

Cooling of the carbonator is used, not only to improve the carbonation, but also as a requirement so that the finally prepared and dispensed drink exhibits a desired low and basically constant temperature. The cooling in the carbonator is achieved by a cooling system, which is adapted to form an ice bank or layer of generally uniform thickness along the inner side walls of the carbonator as a result of the circulating water. Consequently, a cooling capacitor is produced, thus enhancing its "refrigerating capacity", thereby removing the need for a relatively powerful cooling system which would be necessary in a once-through cooling system.

When a freshly prepared beverage of a certain type is desired, a valve is opened in an output line connected to the bottom area of the carbonator, whereupon cooled carbonated water, metered by a flow-volume regulating valve, is fed to a mixing station to which a correspondingly metered amount of a selected drink concentrate is also fed. To provide a possibility of selection among several concentrates, the carbonated water is individually fed to a dispensing point of the individual concentrate or conveyed past all dispensing points in succession for example, by a mixing station. The bringing-together of different concentrates at one and the same mixing point is somewhat more complicated.

It may also be desirable to prepare and dispense beverages without $CO_2$ content in addition to beverages with $CO_2$ content. So that beverages made with fresh or uncarbonated water can be provided, it becomes desirable that cooled fresh water also be delivered to the mixing station. Conventional apparatus typically includes a separate cooled fresh water storage tank and associated apparatus.

SUMMARY OF THE INVENTION

The principal object of this invention is, therefore, to provide a post-mix beverage dispensing system which prepares beverages for immediate consumption with either carbonated or non-carbonated water.

Apparatus which meets these requirements includes a carbonator having a feed water branching circuit, coupled to a pressurized fresh water source used to fill a cooled storage tank, which selectively feeds fresh water to the storage tank where the water is mixed with $CO_2$ gas and is fed to a concentrate mixing station or it feeds fresh water through a heat exchanger which is coupled to the cooled carbonated water of the carbonator tank to cool a supply of fresh water which is then delivered to the same mixing station along with the proper concentrate of the proper amount. Thus a selected beverage is delivered to a dispensing station which can either be a carbonated beverage or a non-carbonated beverage.

Accordingly, a drink dispenser for post-mixed beverages can be broadened in its usability so that with a single unit of a relatively compact construction can without a special water storing capability, not only dispense carbonated beverages as in the past, but also non-carbonated beverages as well.

According to the preferred embodiment of the invention, a feed pump is connected from the discharge side of the carbonator tank to one side of a heat exchanger with the other side thereof being connected back to the intake side of the tank, thus providing a closed loop circulating path of chilled carbonated water which acts to cool fresh water which is also used in beverage preparation. The heat exchanger and the lines from and to the storage tank are also embedded in insulation so that no substantial refrigeration losses are encountered. The heat exchanger and the connecting lines actually increase the amount of the cooled carbonated water available.

Since carbonated water has a somewhat lower freezing point than fresh water, the non-carbonated water which leaves the heat exchanger will be sufficiently cooled for its intended use, i.e. non-carbonated beverage preparation.

Heat exchangers for liquid media are well known in the prior art. In this connection, in a preferred type of heat exchanger, liquid flows in opposite directions through adjoining connected chambers of the heat exchanger for providing a more efficient type of heat transfer.

In the preferred embodiment of this invention, the return line for the carbonated water back to the storage tank couples into the top of the storage tank so that the water returned from the heat exchanger is sprayed into the $CO_2$-filled head space of the storage tank. The reintroduction of the return carbonated water to the $CO_2$-filled head space by spraying has the effect of enhancing the carbonated process.

BRIEF DESCRIPTION OF THE DRAWING

The details of the invention as set forth below will be more readily understood when considered together with the accompanying drawing, wherein the FIGURE is a mechanical schematic diagram illustrating the preferred embodiment of the invention.

DETAILED DESCRIPTION OF THE INVENTION

Referring now to the drawings, as the FIGURE illustrates, three concentrate tanks 2, each with a separate dispensing system 3, are placed above a mixing station, depicted as a channel 1. As soon as any one of three valve systems 3 is actuated by a controller, not shown, the actuated valve system 3 conveys a suitable amount of a selected drink concentrate from its respective storage tank 2 to the mixing channel 1.

If a carbonated beverage is to be made and delivered to a dispensing station, shutoff valve 4 shown in the drawing is opened concurrently with or spread over time with the operation of a concentrate delivering valve 3, whereupon chilled carbonated water from storage tank 5 is conveyed under pressure through flow-volume regulator 6 to the mixing station 1. In the channel of the mixing station 1, the dispensed drink concentrate and the carbonated water fed from the carbonator tank 5 come together where they are mixed and dispensed into a glass or cup 7 which then can be removed for consumption.

Storage tank 5 comprises a carbonator. Water is sprayed into the top of the tank by a supply line 8 along with $CO_2$ gas which is fed thereto by a supply line 9. Both the water and the $CO_2$ are supplied under pressure. The water pressure is produced by a pressure feed pump 10, which draws the water, in this embodiment, from a water storage tank 11. If storage tank 5 requires replenishment, fresh water from the source 11 is delivered thereto via supply line 8 through an opened shutoff valve 12, a pair of check valves 29 and a T coupler 28. The water level within storage tank 5 is detected by a water level sensor 13 and apparatus to control the operation of pressure feed pump 10 and shutoff valve 12. The $CO_2$ gas supply is automatically regulated by a pressure-reducing/pressure-regulating valve, not shown, upstream of the supply line 9, so that, for example, a pressure of 4 bars is built up in the storage tank 5. This internal pressure is also used for forcing carbonated water from the storage tank when the shutoff valve 4 is opened, for delivering carbonated water to the mixing channel 1.

In the head-space region of storage tank 5, a $CO_2$ gas cushion is formed above the water stored therein. $CO_2$ gas is drawn down into a circulating pump 14 by a suction pipe 16 and mixed in the stored water in the vicinity of the pump 14. The pump is driven by an electric motor 15 which is located beneath it in the bottom of the tank. In this way, the water is circulated, and rotated inside the storage tank around a vertical axis defined by the suction pipe 16.

The carbonated water which is stored within the storage tank 5 is cooled by a set of cooling coils 17 of a cooling system, not shown, located outside of the storage tank 5. With such an arrangement, a layer or bank of ice 18 is formed inside the storage tank 5 on the inner surface of the side wall adjacent the cooling coils 17. The thickness of the ice bank 18 is detected by a sensor 19 whose output controls the actuation of the cooling system.

The carbonated water inside storage tank 5 is thus cooled to a temperature near the freezing point. Because of the nature of water, the relatively warmer zones of water lie in the bottom portion of the storage tank 5 near a dispensing opening which is formed through the housing of electric motor 15, and thus a danger of icing in this area is prevented.

The ice bank 18 represents the refrigerating capacity for storage tank 5. Thus for a short time interval, several portions of sufficiently cooled beverages can be dispensed without the cooling system having to be activated.

If now a non-carbonated beverage is to be dispensed instead of a carbonated beverage, one of the valves 3 for adding the drink concentrate is actuated. But now shutoff valve 4 remains closed while shutoff valve 20 is opened. Since the water pressure of storage tank 5 is lacking, hydraulic feed pump 10 is actuated simultaneously with the opening of shutoff valve 20. The shutoff valve 12 is now also closed. The feed water is now diverted into a branch circuit at a branch point 21 and conveyed through an opened shutoff valve 20 and flow-volume regulator 22 to the mixing channel 1 where it comes into contact with and mixes with the selected drink concentrate before reaching the cup type container 7.

From the branch point including T coupler 21 to shutoff valve 20, a first feed line 23 of a heat exchanger 24 for liquids directs fresh water from the supply 11 and pressure pump 10 to the dispensing point 1 via the valve 20 and flow regulator 22. A second feed line 25 of the heat exchanger 24 is configured so as to define a zig-zag or tortuous flow path which carries carbonated water back and forth in opposite directions to cool the non-carbonated water in the fresh water feed line 23. The second feed line 25 of the heat exchanger 24 is fed carbonated water from the bottom of the storage tank 5 by a feed pump 26 and the T coupler 27. The output side of the second feed line 25 couples back to the supply line 8 by the T coupler 28 so that the carbonated water leaving the heat exchanger 24 is fed back into storage tank 5, by spraying, in the same way that fresh water is initially fed into the tank 5 for carbonation. The non-return check valves 29 prevent the carbonated water from flowing back into the water supply line through valve 12 when opened. This removes the necessity of a separate external cooling system for fresh water used in the preparation of non-carbonated beverages.

Although the heat exchanger 24 cools the noncarbonated water, the refrigerating capacity of the ice bank 18 also plays a part, since the circulation of the carbonated water from the storage tank 5 through the heat exchanger 24 and again back to the storage tank 5 results in a heat exchange or cooling due to the presence of the ice bank 18 which is used to cool the carbonated water. Moreover, the amount of available cooled water from the storage tank 5 is increased by the heat exchanger 24.

The invention being thus described, it will be obvious that the same may be varied in many ways. such variations are not to be regarded as a departure from the spirit and scope of the invention, and all such modifications as would be obvious to one skilled in the art are intended to be included within the scope of the following claims.

I claim:

1. Apparatus for preparing and dispensing post-mix beverages, comprising:

a cooled storage tank for holding carbonated water used in preparing post-mix beverages;

means for supplying fresh water under pressure to the storage tank;

means for introducing $CO_2$ into the storage tank;

branch circuit means coupled to said supplying means and including first water delivery means for selectively delivering fresh water to the storage tank for mixing with $CO_2$ therein to produce carbonated water and second water delivery means for delivering fresh water to a mixing station when a non-carbonated beverage is desired;

third water delivery means for delivering carbonated water from the storage tank to said mixing station when a carbonated beverage is desired;

said second water delivery means including heat exchanger means for cooling the fresh water delivered thereto, said heat exchanger including a first and a second water feed line thermally coupled together, said first water feed line being coupled between said supplying means and said mixing station, and said second water feed line being coupled between said first water delivery means and said third water delivery means for circulating cooled carbonated water in said storage tank through said second water feed line and thereby cooling the fresh water in said first water feed line; and concentrate container means for holding and conveying a predetermined amount of at least one drink concentrate to said mixing station when a carbonated or a non-carbonated beverage is desired.

2. The apparatus according to claim 1 wherein said second water feed line defines a non-linear flow path past said first water feed line.

3. The apparatus according to claim 1 wherein said second water feed line defines a tortuous flow path past said first water feed line.

4. The apparatus according to claim 1 and additionally including selectively actuated flow first and second control valves respectively coupled in said third water delivery means and first water feed line for selectively delivering carbonated water and noncarbonated water to said mixing station.

5. The apparatus according to claim 1 and additionally including a circulating pump connected in said second water feed line for causing carbonated water to circulate between said storage tank and said heat exchanger.

6. The apparatus according to claim 1 and additionally including means for forming an ice bank on the inside of the water tank for cooling carbonated water inside the storage tank.

7. The apparatus according to claim 1 and additionally including means in the storage tank for mixing $CO_2$ with the fresh water fed thereto to produce carbonated water.

8. The apparatus according to claim 1 wherein said first water delivery means sprays water into the top portion of the storage tank.

9. The apparatus according to claim 1 and additionally including a selectively operated flow control valve in said means for supplying fresh water to the storage tank, and wherein said circulating pump is actuated when said flow control valve is closed.

10. The apparatus according to claim 9 wherein said third water delivery means is connected to a bottom portion of the storage tank and said first water delivery means is connected to a top portion of the storage tank.

11. The apparatus according to claim 9 and additionally including a water pump in said means for supplying water to the storage tank.

* * * * *